US005735096A

United States Patent [19]

Krass

[11] Patent Number: 5,735,096

[45] Date of Patent: Apr. 7, 1998

[54] INFILLING SYSTEM FOR WALLS AND FACINGS IN CONSTRUCTION

[75] Inventor: Reinaldo Krass, Milan, Italy

[73] Assignee: Akraplast S.R.L., Milano, Italy

[21] Appl. No.: 676,296

[22] PCT Filed: Feb. 8, 1995

[86] PCT No.: PCT/EP95/00451

§ 371 Date: Jul. 18, 1996

§ 102(e) Date: Jul. 18, 1996

[87] PCT Pub. No.: WO95/22665

PCT Pub. Date: Aug. 24, 1995

[30] Foreign Application Priority Data

Feb. 17, 1994 [IT] Italy ..... MI9400109 U

[51] Int. Cl.[6] ..... E04C 3/00; E04D 1/36

[52] U.S. Cl. ..... 52/464; 52/235; 52/461; 52/463; 52/459; 52/480; 52/772; 52/775; 52/468

[58] Field of Search ..... 52/235, 459, 461, 52/463, 464, 468, 471, 741.4, DIG. 17, 480, 772, 775

[56] References Cited

U.S. PATENT DOCUMENTS

| | | | |
|---|---|---|---|
| 1,209,378 | 12/1916 | Barks | 52/459 X |
| 3,858,377 | 1/1975 | Browne et al. | 52/463 X |
| 4,074,486 | 2/1978 | Grearson | 52/463 X |
| 4,631,884 | 12/1986 | Reynolds | 52/464 X |
| 5,088,255 | 2/1992 | Emanuel | 52/461 X |
| 5,481,839 | 1/1996 | Lang et al. | 52/461 X |

*Primary Examiner*—Carl D. Friedman
*Assistant Examiner*—W. Glenn Edwards
*Attorney, Agent, or Firm*—Young & Thompson

[57] ABSTRACT

A face mounting infilling system for walls and linings of buildings. The infilling elements are designed at their ends in such a way that they may be clamped to the upper edges of lower linking units, which in turn are designed in such a way that upper linking units may be snap-locked thereon.

20 Claims, 1 Drawing Sheet

INFILLING SYSTEM FOR WALLS AND FACINGS IN CONSTRUCTION

BACKGROUND OF THE INVENTION

1. Field of the Invention

This invention relates to an infilling system for walls and linings in construction.

2. Description of the Related Art

Systems conventionally used to infill walls and linings can be divided into three classes depending on the type of their placement:

1. Systems with side overlapping, each unit on one side end overlapping the preceding unit and for its part on the other side end being overlapped by the subsequent unit.

2. Systems with side assembly, the infilling units being inserted into one another laterally and in doing so often managing without special linking units.

3. Systems with end attachment, the infilling units being placed next to one another and in doing so necessitating special linking units in order that their correct placement and water tightness are ensured.

Compared to systems with side overlapping or with side assembly, systems with end attachment offer for example the following advantages:

The infilling units can be individually mounted and dismounted without intervention in adjacent infilling units.

Linking sections can assume support functions; this enables high support capacities so that expensive and unattractive substructures are unnecessary. Systems with end attachment used at present however have some disadvantages:

One major disadvantage arises due to the danger that the infilling units escape from their receivers within the linking sections. In many systems this can be attributed to the fact that the corresponding infilling units have no side hold in the linking units and consequently can escape laterally when bending under load. In the case of other systems the infilling units do not have any effective end interlocking and therefore, especially with strong underpressure or with impact stress acting to the inside, they can separate.

Another disadvantage of the system used at present with end attachment consists in that attachment of the corresponding linking units to the substructures cannot usually be done if all the infilling units have been definitively placed for the time being so that mounting entails a considerable expenditure of time and cost.

SUMMARY OF THE INVENTION

Therefore the object of the invention is to avoid the indicated disadvantages in a generic infilling system with end attachment. This object is achieved according to the invention by the measures indicated in patent claim 1. Advantageous embodiments of the invention are given in the dependent claims.

BRIEF DESCRIPTION OF THE DRAWINGS

The invention is detailed below using a drawing by way of example.

The drawing shows a perspective view of one embodiment for the infilling system according to the invention.

DESCRIPTION OF THE PREFERRED EMBODIMENT

Figure 1:
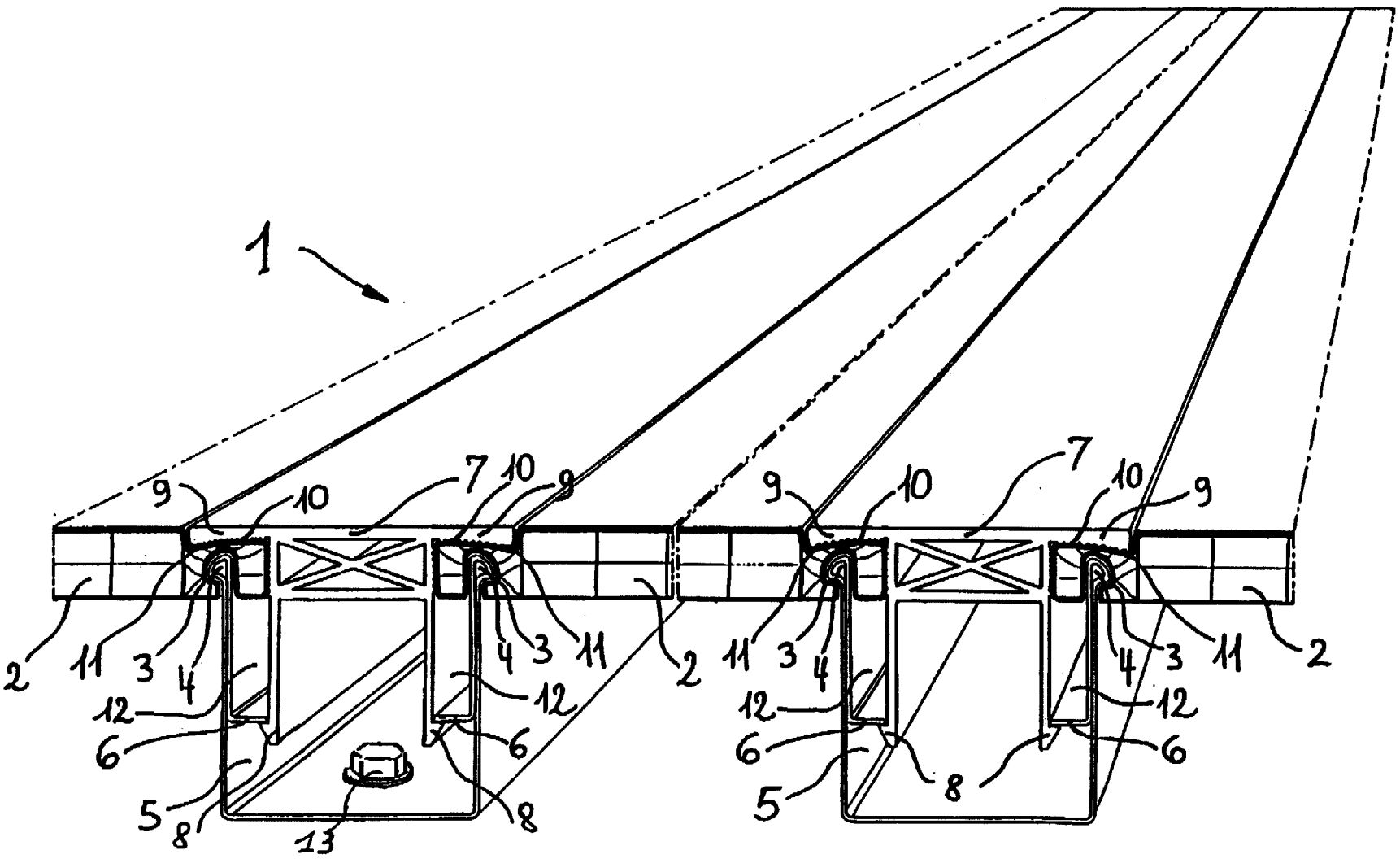

This infilling system is labelled in its entirely with reference number 1.

The infilling system has infilling units 2 with cavities 3 formed on their ends such that their fixation is enabled on upper bulbous ends 4 by lower linking units 5.

The shape of bulbous ends 4 corresponds to the shape of cavities 3 of infilling units 2 and therefore has an upper enlargement, consequently infilling units 2 can be fixed thereto. In this way infilling units 2 are secured both in the lateral direction as well as in the end direction, even if to a lesser degree.

Lower linking units are made with two reversals 6 which are pointed to the inside and which are used to fix upper linking units 7 thereto and for this reason they are provided by two hooks 8 which bend elastically when upper linking units 7 are attached and then in turn assume their original position and in doing so cause coupling with reversals 6 of lower linking units 5.

The mutual distance between reversals 6 in the embodiment will be sufficient to allow passage of possible screws or rivets 13 which enable attachment of linking unit 5.

The upper external wings 9 of upper linking units 7 ensure end interlocking of infilling units 2. In order that upper linking units 7 and infilling units 2 are brought flush to the same height, the latter have a reduced thickness which corresponds to the thickness of wings 9. Wings 9 and infilling units 2 are joined to one another such that water percolation is prevented. Knurling 10 both on wings 9 and also on the section of infilling units 2 with reduced thickness improves water tightness. For the same reason the decrease of thickness of infilling units 2 from the outside to the inside increases so that an appropriate tilt 11 results.

The width of the center section of upper linking units 7 is such that thus with it the distance between adjacent infilling units 2 is filled. This measure increases the stability of the entire system and is used to further prevent water percolation.

Lower linking unit 5 consists preferably of a steel strip which is preferably shaped as shown.

Reversal 6 preferably has a distance from the bottom of infilling unit 2 such that a gutter which is used to drain water which may have percolated through can be formed.

Because there are cavities 3 and bulbous ends 4, infilling units 2 can be mounted without upper linking unit 7 needing to be attached immediately., especially since an inherently stable unit is formed. Upper linking units 7 can rather also be attached after all lower linking units 5 and all infilling units 2 have been mounted.

Infilling units 2 and hooks 8 of upper linking units 7 should obviously consist of a material elastic enough to perform their task.

I claim:

1. Infilling system for walls and linings in construction with end attachment, wherein infilling units (2) on their ends are made such that they have cavities (3) in which upper bulbous ends (4) are fixed by lower linking units (5) which for their part are made such that upper linking units (7) can be attached thereto by snapping, and wherein the upper linking units (7) are provided with hooks (8) which are used for coupling with the lower linking units (5) and wherein the lower linking units (5) are made with reversals (6) which are pointed inwardly, with their mutual distance allowing passage of at least one of screws and rivets (13) which enable attachment of the lower linking unit (5), and wherein further each infilling unit comprises a shaded portion along each lateral edge thereof, a thickness of the shaped portions being less than a portion of the infilling unit between the shaped portions exposed area being greater than that of the shaped portions, such that the upper linking units fit between adjacent infilling units held together by one of the lower linking units with portions of the upper linking unit thereby overlapping the shaped portions of the infilling units, the overlapping portions having a profile which conforms to the shaped portions of the infilling units such that a forward face of the upper linking unit is essentially even with and abuts a forward face of the portion of the infilling unit between the shaped portions of an adjacent infilling unit.

2. Infilling system according to claim 1, wherein lower linking units (5) are made with two reversals (6) pointed to an inside of the lower linking unit.

3. Infilling system according to claim 1, wherein upper linking units (7) in a lower section are provided with two hooks (8) each.

4. Infilling system according to claim 3, wherein upper external wings (9) of upper linking units (7) are supported on the shaped portions.

5. Infilling system according to claim 4, wherein there are knurls (10) both on wings (9) and also on the shaped portions.

6. Infilling system according to claim 1, wherein reversal (6) of lower linking unit (5) has a distance from a bottom of the infilling unit (2) such that a gutter (12) is formed.

7. Infilling system according to claim 1, wherein the lower linking unit (5) consists of a profiled steel strip.

8. Infilling system according to claim 1, wherein infilling units (2) and hooks (8) of upper linking units (7) are flexible.

9. Infilling system for walls and linings in construction using end attachment, comprising:

infilling units each having a shaped portion along each lateral edge thereof and a portion of the infilling units between the shaped portions having a thickness greater than that of the shaped portions, the shaped portions having a longitudinal recess disposed on a back face thereof;

lower linking units each having an essentially U-shaped profile with edges having a bulbous profile, two ledges projecting inward from opposite interior sides of the lower linking units; and upper linking units each having a front panel and two planar protrusions extending opposite a forward face of the front panel, each protrusion terminating in a latch;

wherein the bulbous profiled edges of the lower linking units are capable of snapping into the longitudinal recesses of the infilling units, thereby holding two infilling units together; and the front panel of the upper linking units may be installed between adjacent infilling units held together by one of the lower linking units by engaging the latches of the upper linking units with the ledges of the lower linking units, portions of the front panel thereby overlapping the shaped portions of the infilling units, the overlapping portions having a profile which conforms to the shaped portions of the infilling units such that the forward face of the front panel is essentially even with and abuts a forward face of the portion of the infilling unit between the shaped portions of an adjacent infilling unit.

10. The infilling unit of claim 9, wherein mating surfaces between the overlapping portions of the upper linking units and shaped portions of the infilling units are arcuate in cross section.

11. The infilling system of 10, wherein at least one of the overlapping portions of the upper linking units and the shaped portions of the infilling units are knurled along the mating surfaces.

12. The infilling system of claim 11, wherein a width of the front panel of the upper linking unit essentially spans a distance separating the portions of the infilling unit between the shaped portions of two adjacent infilling units when held together by one of the lower linking units.

13. The infilling system of claim 12, wherein the planar protrusions are located on the upper linking unit such that outer surfaces of the planar protrusions contact outer surfaces of the shaped portions of two adjacent infilling units when held together by one of the lower linking units.

14. The infilling unit of claim 13, wherein a surface of the lower linking unit furthest from the front panel of the upper linking unit comprises at least one aperture capable of being used to secure the lower linking unit to another structure.

15. The infilling system of 9, wherein at least one of the overlapping portions of the upper linking units and the shaped portions of the infilling units are knurled along facing surfaces.

16. The infilling system of 9, wherein within each lower linking unit gutters are formed when the infilling units, lower linking units, and upper linking units are assembled.

17. The infilling system of 16, wherein the gutters are formed from outer faces of the planar protrusions, the ledges, inner surfaces of the lower linking units, and an area of the shaped portions of the infilling units.

18. The infilling system of claim 9, wherein a surface of the lower linking unit furthest from the front panel of the upper linking unit comprises at least one aperture capable of being used to secure the lower linking unit to another structure.

19. The infilling system of claim 9, wherein a width of the front panel of the upper linking unit essentially spans a distance separating the portions of the infilling unit between the shaped portions of two adjacent infilling units when held together by one of the lower linking units.

20. The infilling system of claim 9, wherein the planar protrusions are located on the upper linking unit such that outer surfaces of the planar protrusions contact outer surfaces of the shaped portions of two adjacent infilling units when held together by one of the lower linking units.

* * * * *